United States Patent [19]

Narasimhan et al.

[11] Patent Number: 4,564,400

[45] Date of Patent: Jan. 14, 1986

[54] METHOD OF IMPROVING MAGNETS

[75] Inventors: Kalatur S. V. L. Narasimhan, Monroeville; Charles D. Preusch, Pittsburgh, both of Pa.

[73] Assignee: Crucible Materials Corporation, Pittsburgh, Pa.

[21] Appl. No.: 587,412

[22] Filed: Mar. 8, 1984

Related U.S. Application Data

[63] Continuation-in-part of Ser. No. 262,270, May 11, 1981, abandoned.

[51] Int. Cl.[4] ..... H01F 1/02

[52] U.S. Cl. ..... 148/103; 148/104; 148/105

[58] Field of Search ..... 75/211; 148/103, 104, 148/105, 108; 419/30, 38, 42, 49, 68

[56] References Cited

U.S. PATENT DOCUMENTS

| | | | |
|---|---|---|---|
| 3,695,945 | 10/1972 | Benz | 148/103 |
| 3,821,034 | 6/1974 | Westendorp et al. | 148/103 |
| 3,977,918 | 8/1976 | Paladino et al. | 148/108 |
| 4,003,767 | 1/1977 | Bachmann et al. | 148/103 |
| 4,081,297 | 3/1978 | Nagel | 148/108 |
| 4,087,291 | 5/1928 | Gaiffi et al. | 148/108 |
| 4,090,892 | 5/1978 | Klein et al. | 148/103 |
| 4,092,184 | 5/1978 | Stucker | 148/108 |
| 4,144,105 | 3/1979 | Gaiffi et al. | 148/108 |

OTHER PUBLICATIONS

Waldron et al, *Sintering,* 1978, p. 60.

Jones, *Fundamental Principles of Powder Metallurgy,* 1960, p. 339.

Sands et al, *Powder Metallurgy Practice and Applications,* 1967, p. 75.

*Primary Examiner*—John P. Sheehan

*Attorney, Agent, or Firm*—Finnegan, Henderson, Farabow, Garrett & Dunner

[57] ABSTRACT

A method for producing magnets from powdered magnetic alloy, and magnets having improved remanence and good coercive force; the method comprises aligning a particle charge of magnet alloy within a container, which aligning may be achieved by use of a pulsating magnetic field; consolidating the charge after alignment to a density in excess of 95% of theoretical density by cold or hot isostatic pressing, or a combination thereof.

14 Claims, No Drawings

METHOD OF IMPROVING MAGNETS

This is a continuation-in-part of patent application Ser. No. 262,270, filed May 11, 1981 now abandoned.

It is conventional practice to produce magnets from powdered magnetic alloys, including rare earth cobalt magnets, by compacting as by die pressing a charge of aligned or oriented fine powder of a mangetic alloy of the desired magnet composition. Thereafter, the compacted charge is heat treated at temperatures on the order of 2000° to 2090° F. It is known that by increasing the density in the production of magnets of this type from particle charges of the magnetic material that remanence can be improved. Conventionally, density is increased by raising the sintering temperature after the die pressing; however, this results in a corresponding lowering of coercive force.

It is accordingly an object of the present invention to provide a method for producing from powdered magnetic alloy magnets with increased density, and thus improved remanence, without resorting to higher sintering temperatures that serve to lower coercive force.

Another object of the invention is in the production of magnets to provide for improved alignment or orientation to achieve higher remanence values.

These and other objects of the invention will be apparent from the following description and specific examples.

It has been determined broadly in accordance with the invention that improved remanence is a function of both the degree of alignment of the individual magnetic dipoles (powder particles) and density (the number of dipoles that are present in a given volume of the body of the magnet material). Accordingly, in the broader aspects of the invention it has been discovered that if one subjects a particle charge of magnet alloy, which may be one or more transition elements, e.g. nickel, cobalt, iron, chromium, manganese, copper, zirconium and titanium, in combination with at least one rare earth element, e.g. samarium, to a temperature that is below the full density sintering temperature but above the temperature necessary to produce a close-pore structure and then subjects the material while at this temperature to isostatic compacting, increased density and thus improved remanence is achieved while maintaining good coercive force. Coercive force is maintained by maintaining the temperature below the full density sintering temperature. Additionally, remanence is improved by aligning or orienting the material by the use of a pulsating magnetic field within a container. The container may be collapsible within which the material can thereafter be isostatically compacted. The pulsating magnetic field should have a pulse duration not exceeding one second per pulse and each pulse typically will be on the order of 15 millisecond. At least one pulse and preferably two pulses at a power level of at least 50,000 Oe is suitable for the purpose. Conventionally, highly oriented $SmCo_5$ magnets have been produced by the use of superconducting solenoids to generate the high-intensity magnetic fields. These superconducting solenoids must be operated at cryogenic temperatures (−450° F.) to pass the high-density current necessary to generate these high-intensity magnetic fields. In the practice of the invention, however, the required high-intensity magnetic fields are produced by discharging an assemblage of capacitors, e.g. four hundred to one thousand capacitors, thereby eliminating the need for super-conducting solenoids. The container may be a rubber bag and preferably after alignment the bag is evacuated in the presene of a constant DC field which serves to maintain alignment. Alternatively, the particles of magnet material may be aligned within a preformed container, which will be collapsible and of a material such as stainless steel. The step of subjecting the aligned material to a steady DC field in an evacuated container has been found to "lock in" the alignment and thus insure improved remanence. The following constitutes specific examples with respect to the practice of the invention as described above and demonstrate its utility:

EXAMPLE 1

$SmCo_5$ powder was oriented in a die cavity with an applied magnetic field and pressed. The applied field and the pressing direction being normal to each other. The pressed powder after sintering and post sintering had the properties as set forth in Table I.

The sintered magnet was loosely wrapped with stainless steel foil (not pressure tight; for handling convenience only) and as-hot-isostatically pressed (HIPed) at 1750° F. The as-HIPed magnet had the properties as set forth in Table I.

The HIPed magnet was reheat treated at 1670° F. for three hours and quenched. The magnetic properties after HIPing and heat treatment are set forth in Table I.

TABLE I

| | $B_r$ (G) | $H_c$ (Oe) | $H_{ci}$ (Oe) | $BH_{max}$ MGOe | $H_k$ Oe | $\rho$gm/Cm$^3$ |
|---|---|---|---|---|---|---|
| Die Pressed and Sintered | 8,900 | 8,600 | 15,100 | 19.8 | 12,400 | 8.07 |
| After HIP | 9,400 | 9,100 | 11,500 | 22.1 | 10,000 | 8.53 |
| Heat Treatment after HIP | 9,400 | 9,200 | >20,000 | 22.1 | 15,800 | |

EXAMPLE 2

Another magnet prepared according to the same procedure prescribed as in Example 1 had the properties set forth on Table II.

TABLE II

| | $B_r$ G | $H_c$ Oe | $H_{ci}$ Oe | $BH_{max}$ MGOe | $H_k$ Oe | $\rho$gm/Cm$^3$ |
|---|---|---|---|---|---|---|
| Die Pressed and Sintered | 9,000 | 8,400 | 14,000 | 19.0 | 9,400 | 8.07 |
| After HIP | 9,400 | 8,800 | 10,600 | 21.1 | 9,200 | 8.53 |

EXAMPLE 3

Another magnet of $SmCo_5$ from a batch order than in Examples 1 and 2 was prepared as described in Example 1. The properties are recorded in Table III.

TABLE III

| | $B_r$ G | $H_c$ Oe | $H_{ci}$ Oe | $BH_{max}$ MGOe | $H_k$ Oe |
|---|---|---|---|---|---|
| Die Pressed and Sintered | 9,200 | 8,800 | >20,000 | 21.0 | 9,400 |
| After HIP | 9,600 | 4,600 | 7,600 | 13.2 | 2,200 |
| Heat Treatment after HIP | 9,600 | 9,400 | >20,000 | 22.5 | 9,600 |

It may be seen from the magnetic property data that remanence is improved by hot isostatic pressing after conventional aligning and cold pressing. Further improvement is achieved with respect to coercive force when after hot-isostatic pressing the magnet is subjected to post sintering heat treatment. The deterioration of the coercive force after HIPing is believed to be due to phase separation.

EXAMPLE 4

Using the powder from the same batch as in Example 3, a magnet was made by sintering $SmCo_5$ powder that was previously oriented and cold isostatically pressed. The magnet had the properties set forth in Table IV.

TABLE IV

| | $B_r$ G | $H_c$ Oe | $H_{ci}$ Oe | $BH_{max}$ MGOe | $H_k$ Oe | $\rho$gm/Cm$^3$ |
|---|---|---|---|---|---|---|
| Cold Isostatically Pressed and Sintered | 9,700 | 9,000 | 17,700 | 23.5 | 9,600 | 8,31 |
| After HIP | 9,800 | 6,000 | 7,000 | 22.0 | 5,200 | 8.49 |
| Heat Treatment after HIP | 9,800 | 9,200 | >20,000 | 24.0 | 12,400 | |

With the magnetic alloy of Example 4 the theoretical maximum density is 8.6 gm/Cm$^3$. The specific magnet had a density of 8.31 gm/Cm$^3$ before hot isostatic pressing and the density increase after hot isostatic pressing was only about 2%, which accounts for small improvement in remanence reported in the example. It is anticipated that if the theoretical maximum density had been achieved during hot isostatic pressing about a 3% increase in remanence would result.

EXAMPLE 5

$SmCo_5$ alloy was loaded into a stainless container and hydrogen admitted into the container. The pressure was built up to 30 atmospheres; hydrogen absorption by the alloy results in an disintegration of the alloy to about −60 mesh powder. The dehydrided powder was jet milled to about 4$\mu$ particle size.

The fine powder was loaded into a rubber bag of $\frac{3}{4}$" diameter and the bag was contained in a stainless or plastic sheath. The bag was then pressurized and the powder oriented by placing the rubber bag along with the sheath inside a coil, and pulsing the coil, at least three times, with enough power to generate 60,000 Oe within the coil.

The oriented powder was then placed in a steady DC field pf ~10 KOe and the bag evacuated to lock the alignment. The evacuated bag containing the powder was then placed in an isostatic press chamber and compressed with a pressure up to 100,000 psi. The green compact was subsequently sintered between 1000°-1200° C. and post sinter aged between 870°-930° C.

The magnets prepared from these four batches of powder in the manner described above had the properties set forth in Table V, which Table also shows magnetic properties of conventional commercial magnets.

TABLE V

| | $B_r$ G | $H_c$ Oe | $H_{ci}$ Oe | $BH_{max}$ MgOe | $H_k$ Oe |
|---|---|---|---|---|---|
| Batch #I | 10,000 | 9,600 | 11,800 | 24 | 8,600 |
| Batch #II | 10,200 | 10,200 | 18,000 | 26 | 14,800 |
| Batch #III | 10,600 | 9,800 | 17,000 | 28 | 10,400 |
| Batch #IV | 10,200 | 9,600 | 15,300 | 25 | 10,800 |
| Commercial | 8,800 | 8,600 | 15,000 | 19 | 10,000 |

TABLE V-continued

| | $B_r$ G | $H_c$ Oe | $H_{ci}$ Oe | $BH_{max}$ MgOe | $H_k$ Oe |
|---|---|---|---|---|---|
| Magnets | 9,200 | 8,800 | 20,000 | 21 | 10,000 |

EXAMPLE 6

Powder of $SmCo_5$ was loaded in a rubber bag and oriented in the poles of an electromagnet in a field of 25 kOe. The oriented powder was then evacuated maintaining the steady DC field. The evacuated bag containing the oriented powder was isostatically pressed followed by sintering and heat treatment. The magnet had the following properties shown in Table VI.

TABLE VI

| | $B_r$ G | $H_c$ Oe | $H_{ci}$ Oe | $BH_{max}$ MGOe |
|---|---|---|---|---|
| Magnet Prepared without a Pulsating d.c. Field | 8,900 | 6,400 | 7,200 | 19.0 |

EXAMPLE 7

A fourth batch of $SmCo_5$ was processed into magnets by procedures as described in Example 1 except for a change in the compaction method. The powder contained in the bag after alignment was initially compacted inside the bag by placing the bag towards the end of the coil and employing the field gradient present in the coil during pulsing to bring forth an initial compaction to an intermediate density by additional pulsing. The oriented compacted powder placed in a steady DC field was evacuated, isostatically pressed and sintered. The sintered sample was of uniform diameter and had a flat top and bottom contrary to the samples prepared without the field gradient packing which had a pyramidal top. The magnetic properties of the sintered magnet prepared as per this example are shown in Table VII.

TABLE VII

| $B_r$ G | $H_c$ Oe | $H_{ci}$ Oe | $BH_{max}$ MGOe | $H_k$ Oe |
|---|---|---|---|---|
| 10,000 | 9,800 | >20,000 | 25.0 | 13,000 |

EXAMPLE 8

A rectangular preform which has the dimensions of a die cavity was loaded with powder and the powder was oriented in a pulse coil. The oriented powder in the preform was transferred to a die press and placed between the upper and lower punches. After all the powder has transferred into the die cavity the powder was pressed between the upper and lower punches under the application of a DC field. The die pressed part was sintered and post sintered. The magnet prepared in this manner had the following properties set forth on Table VIII.

EXAMPLE 9

From the same batch of powder one magnet was pressed by directly feeding the powder into the die cavity, applying the DC field, and pressing. The properties of these two magnets are set forth in Table VIII.

TABLE VIII

| | $B_r$ G | $H_c$ Oe | $H_{ci}$ Oe | $BH_{max}$ MGOe | $H_k$ Oe |
|---|---|---|---|---|---|
| Premagnetized powder in a preform before transferring into the die cavity | 9,750 | 8,700 | >10,000 | 23.7 | 8,800 |
| Direct location of powder in the die cavity | 8,800 | 7,400 | >10,000 | 19.0 | 6,000 |

It may be seen from the data reported in Examples 5 through 9 that aligning by the use of a pulsating magnetic field in accordance with the practice of the invention, as opposed to the conventional practice of aligning by the use of a steady-state magnetic field, resulted in improvement in remanence and energy product.

EXAMPLE 10

$SmCo_5$ powder was placed inside a can and a pulsating field was applied to the powder before sealing the can. The sealed can was then hot isostatically pressed. The HIPed sample was then heat treated. The following magnetic properties were measured on the sample:

TABLE IX

| $B_r$ (G) | $H_c$ (Oe) | $H_{ci}$ (Oe) | $BH_{max}$ (MGOe) | $H_k$ (Oe) |
|---|---|---|---|---|
| 10,080 | 8,300 | 15,000 | 25 | 7,850 |

We claim:

1. A method for improving the remanence of magnets produced by consolidating a particle charge of a transition metal-rare earth alloy to form a magnet article, said method comprising applying a magnetic field to said particle charge within a container to magnetically align said particles, said magnetic field being applied as a plurality of pulses with each said pulse having a duration not exceeding one second and a power level of at least 50,000 oersted and thereafter consolidating said particle charge to a final density.

2. The method of claim 1 wherein said particles are loaded into a collapsible container for magnetic alignment and subsequent consolidation.

3. The method of claim 2 wherein said container is a rubber bag.

4. The method of claim 1 wherein said container is preformed to the desired shape of the particle charge after consolidation.

5. The method of claim 2 wherein said container is evacuated in the presence of a DC electric field after alignment of said particles.

6. The method of claim 1 wherein said alloy contains cobalt as at least one transition element.

7. The method of claim 1 wherein said alloy contains samarium as at least one rare earth element.

8. The method of claim 1 wherein after magnetic alignment of said particles, said particles are compacted to an intermediate density by additional pulsing.

9. The method of claim 1 wherein consolidation is by die pressing pulse sintering.

10. The method of claim 1 wherein consolidation is by cold isostatic compaction plus sintering.

11. A method for improving the remanence of magnets produced by consolidating a particle charge of a transition metal-rare earth alloy to form a magnet article, said method comprising applying a magnetic field to said particle charge within a container to magnetically align said particles, said magnetic field being applied as a plurality of pulses with each pulse having a duration not exceeding one second and a power level of at least 50,000 oersted, heating to a temperature below the full density sintering temperature thereof but above the temperature necessary to render the particle charge substantially gas impervious, and thereafter hot isostatically pressing said particles to consolidate the same to full density.

12. The method of claim 11 wherein said container is evacuated in the presence of a DC electric field after alignment of said particles.

13. The method of claim 11 wherein said alloy contains cobalt as at least one transition element.

14. The method of claim 11 wherein said alloy contains samarium as at least one rare earth element.

* * * * *